US010408491B2

(12) United States Patent
Carton et al.

(10) Patent No.: US 10,408,491 B2
(45) Date of Patent: Sep. 10, 2019

(54) PANEL FOR A MODULE OF AN AIR HANDLING UNIT

(71) Applicant: Carrier Corporation, Farmington, CT (US)

(72) Inventors: Thomas Carton, Eloise (FR); Samuel Duchet, Lyons (FR); Bertrand Jacquin, Saint Maximin (FR); Marc Serra, Andert et Condon (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/558,494

(22) PCT Filed: Mar. 16, 2016

(86) PCT No.: PCT/US2016/022673
§ 371 (c)(1),
(2) Date: Sep. 14, 2017

(87) PCT Pub. No.: WO2016/149390
PCT Pub. Date: Sep. 22, 2016

(65) Prior Publication Data

US 2018/0080677 A1 Mar. 22, 2018

(30) Foreign Application Priority Data

Mar. 18, 2015 (FR) ..... 15 52231

(51) Int. Cl.
*F24F 13/20* (2006.01)
*F24F 3/044* (2006.01)

(52) U.S. Cl.
CPC ..... *F24F 13/20* (2013.01); *F24F 3/0442* (2013.01); *F24F 3/044* (2013.01)

(58) Field of Classification Search
CPC ..... F24F 13/20; F24F 3/044; F24F 3/0442
See application file for complete search history.

(56) References Cited

U.S. PATENT DOCUMENTS

2007/0290586 A1 12/2007 Rosete et al.
2010/0316236 A1* 12/2010 Snider ..... H04R 7/045 381/152

(Continued)

FOREIGN PATENT DOCUMENTS

CH 654648 A5 2/1986
CN 200995801 Y 12/2007

(Continued)

OTHER PUBLICATIONS

International Search Report and Written Opinion for application PCT/US2016/022673, dated Jun. 27, 2016, 11 pgs.

*Primary Examiner* — Ana M Vazquez
(74) *Attorney, Agent, or Firm* — Cantor Colburn LLP

(57) ABSTRACT

This panel (6) for a module of an air handling unit defines a main axis perpendicular to its surface and includes an outer plate (8), an inner plate (10), a layer (12) of insulating material arranged between the outer plate and the inner plate, and a joining element (14) arranged around the layer of insulating material and intercalated between the outer plate and the inner plate along the main axis. The plates and the layer of insulating material are parallel to each other and perpendicular to the main axis of the panel. The joining element includes both a male assembly part (34) formed by a projecting rib and a female assembly part (36) formed by a hollow groove and the projecting rib of the joining element is configured to nest into the hollow groove of another joining element with an identical transversal section belonging to another panel.

10 Claims, 5 Drawing Sheets

(56) References Cited

U.S. PATENT DOCUMENTS

| | | | | |
|---|---|---|---|---|
| 2012/0205078 | A1* | 8/2012 | Baumeister | A47B 47/0041<br>165/104.34 |
| 2013/0032310 | A1* | 2/2013 | Jaena | F28D 15/02<br>165/104.25 |

FOREIGN PATENT DOCUMENTS

| | | | | |
|---|---|---|---|---|
| FR | 2292085 | A1 * | 6/1976 | E04C 2/292 |
| FR | 2292085 | A1 | 6/1976 | |
| WO | 9940374 | A1 | 8/1999 | |

* cited by examiner

PANEL FOR A MODULE OF AN AIR HANDLING UNIT

The present invention relates to a panel for a module for an air handling unit. The present invention also relates to a module for an air handling unit comprising such a panel and to an air handling unit comprising such a module.

In the area of the handling of air it is known to use an air handling unit composed by a series of modules, wherein each module comprises a component relative to a function of the treatment of air. Each module comprises four, five or six faces, wherein each face is composed by a panel. In a known manner each panel comprises an outer plate, an inner plate and a layer of insulating material sandwiched between the outer plate and the inner plate. Such panels pose problems, especially for being assembled on one and the same face of the air handling unit. In fact, the adjustment in height, in depth and the parallelism of these panels is a real difficulty. A perfect alignment of the panels cannot be achieved and a bad image of the quality mark risks being transmitted by the unit. Moreover, when the inner and outer plates are tightened against one another, since the two plates consist of metal, a thermal bridge is created with the consequence of thermal leaks from the inside to the outside or from the outside to the inside of the unit. Finally, according to such an approach the modules of the air handling unit necessitate the implementation of a structure framework, which implies a heavy unit and an elevated cost.

In order to ensure a better alignment, the use of thick, movable wedges is known for positioning the panels manually before their definitive fixation on the modules. However, such an approach remains long and complicated for an operator.

In order to reduce the thermal bridges between the inner and the outer plates, it is known to introduce a fine layer of insulating material where the plates are pressed one against the other. However, such an approach does not allow the thermal bridges to be completely eliminated.

Moreover, in order to eliminate the structure framework, it is known to assemble the panels directly on one another in such a manner as to form a self-supporting module. However, such an approach is only applicable for units with a reduced size.

In this context it is known, for example from EP-A-2 578 959 to provide each panel with a joining element arranged all around the layer of insulating material sandwiched between the inner and the outer plates. According to this approach the joining element is of metal and comprises either a male connector or a female connector in such a manner that the panels can be assembled and aligned among themselves. In other words, two types of joining element must be manufactured and mounted on the panels, namely a "male" piece and a "female" piece, which entails relatively high production costs. Furthermore, such a panel does not completely eliminate the problems relative to the thermal bridges between the outer and inner plates and the unit still requires the structure framework.

The invention intends to remedy these disadvantages in particular by proposing a novel panel which ensures the alignment between the panels at a lower cost.

In this spirit the invention relates to a panel for a module of an air handling unit, which panel defines a main axis perpendicular to its surface and comprises an outer plate, an inner plate, a layer of insulating material arranged between the outer plate and the inner plate, and a joining element arranged around the layer of insulating material and intercalated between the outer plate and the inner plate along the main axis, which plates and the layer of insulating material are parallel to each other and perpendicular to the main axis of the panel. In conformity with the invention the joining element comprises both a male assembly part formed by a projecting rib and a female assembly part formed by a hollow groove. Furthermore, the projecting rib of the joining element is configured to fit into the hollow groove of another joining element with an identical transversal section belonging to another panel.

The projecting rib and the hollow groove are realized on the same piece by virtue of the invention. In practice, the joining element comprises a single identical piece, which reduces the production cost of the panel.

According to advantageous but not obligatory aspects of the invention such a panel comprises one or several of the following characteristics taken in any technically admissible combination:

- The projecting rib and the hollow groove of the joining element are arranged on the faces of the joining element which are perpendicular among themselves.
- The joining element consists of thermally insulating material, in particular of polymeric material.
- The joining element comprises stiffening ribs which are arranged inside a closed volume defined by a contour of the joining element.
- At least one plaque from the outer plaque and the inner plaque is provided with a turned-down edge and the turned-down edge is arranged in a niche of the joining element.
- The joining element comprises two niches which respectively receive a turned-down edge of the outer plate and a turned-down edge of the inner plate, which joining element defines a closed volume, the projecting rib is arranged on a wall of the closed volume, a first niche is defined between the closed volume and the hollow groove and the second niche is perpendicular to the first niche.
- A thick interval parallel to the main axis of the panel is defined between the layer of insulating material and the plate among the outer plate and the inner plate.

The invention also relates to a module for an air handling unit, which module comprises several faces, at least one face of which is composed by a panel such as described above.

According to a particular embodiment the hollow groove of the joining element of the panel of a first face receives the projecting rib of the joining element of the panel of a second face adjacent to the first face and perpendicular to the latter.

Finally, the invention also relates to an air handling unit comprising a plurality of modules and a plurality of components, wherein each module includes a component, which component is a ventilation unit, includes a hot battery and/or a cold battery, at least one filter, mobile slat flaps, a recuperation unit and a humidifier, which unit is characterized in that at least one module is as described above and the joining element belongs to a structure framework for the unit.

The invention will be better understood and other advantages of it will appear more clearly in light of the following description given solely by way of non-limiting example with reference made to the attached drawings in which.

Figure 1:
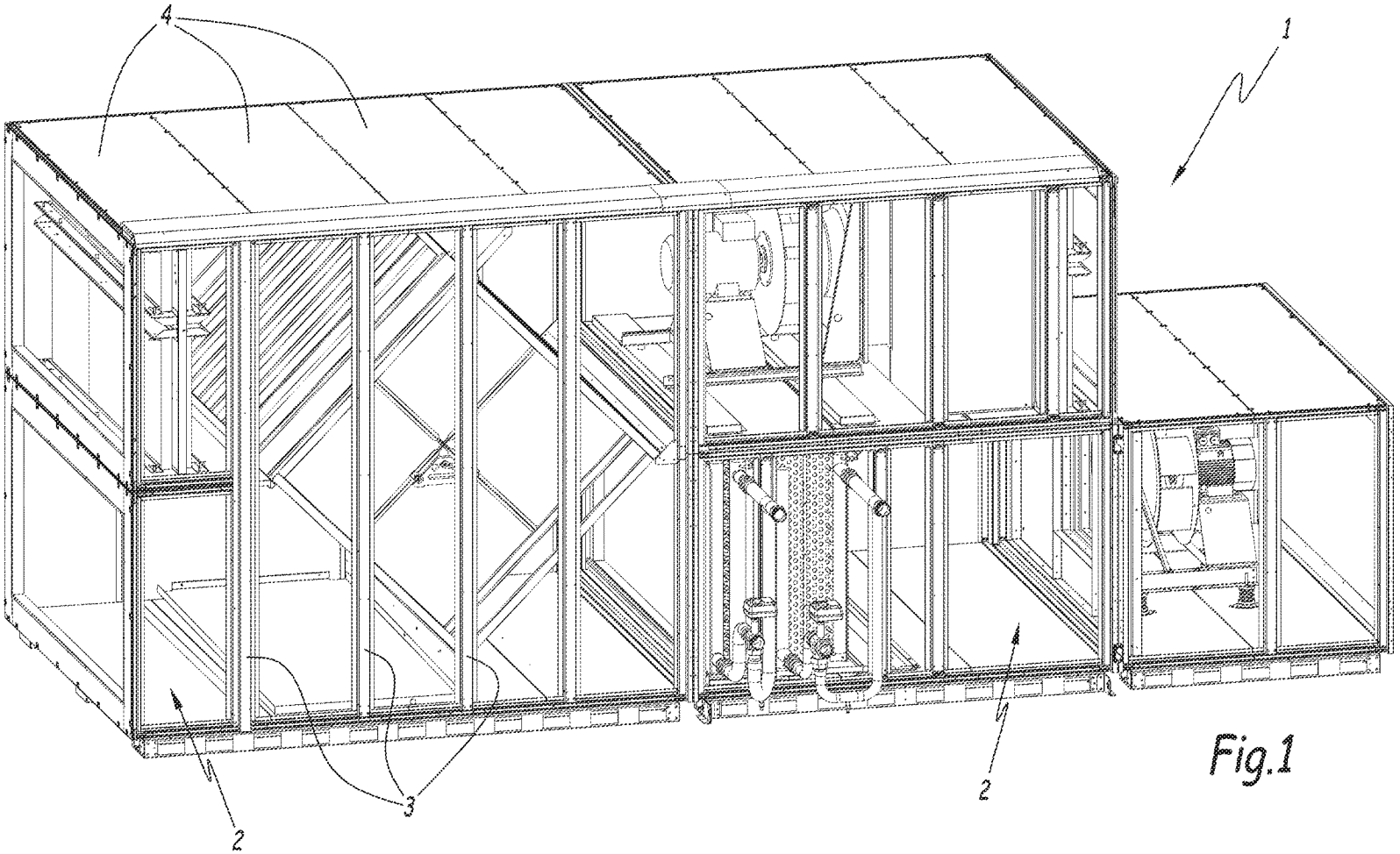
FIG. 1 is a perspective view of an air handling unit of which certain panels were withdrawn.

FIG. 1 shows an air handling unit 1. The unit 1 comprises a plurality of modules 2 and a plurality of components. The unit 1 also comprises vertical bars 3 also called joining T-pieces. The joining T-pieces 3 are positioned vertically between two modules 2 and are configured for integrating vertical panels 6 with the aid of assembly screws. The joining T-pieces 3 do not form a structure framework for the unit 1 as they are not sufficiently rigid and resistant to loads on the unit 1.

Each module 2 of the unit 1 is configured for including at least one component of the unit 1. The components of the unit 1 are, for example, a ventilation unit, a hot battery, a cold battery, filters, mobile slat flaps, a recuperation unit and a humidifier.

The ventilation unit is configured for putting in motion or ventilating the air treated by the unit 1. The ventilation unit operates with the aid of a motor-ventilator group comprising one or several electrical motors which are equipped with one or several turbines.

The hot battery is configured to realize the heating of the air treated by the unit 1. A heat transfer fluid such as, for example, water or gas circulates in the hot battery. As a complement, the heating of the air is ensured, for example, by one or several resistors or also by a gas boiler.

The cold battery is configured to realize the heating of the air treated by the unit 1. A heat transfer fluid such as, for example, water or refrigerating liquid circulates in the cold battery.

The filters are configured to realize the filtration of the air treated by the unit 1. The filters used are a function of the application of the unit 1.

The mobile slat flaps are configured so as to ensure the opening and the closing of one or more circuits of air in the unit 1. Their function is to allow or prevent the passage of the air as needed.

The recuperation unit is configured to recuperate the thermal energy of the air treated by the unit 1. The recuperation unit then comprises a recuperator such as, for example, a plate recuperator, a wheel recuperator, a thermodynamic recuperator, a heat pipe or batteries with glycol water.

The humidifier is configured to regulate the hydrometry of the air treated by the unit 1. The humidifier comprises, for example, a system for the injection of water in the form of drops or of vapor in order to ensure the humidification of the air.

The modules 2 of the air handling unit 1 have several faces 4. In particular, the modules 2 shown in FIG. 1 comprise four or five faces 4 as a function of their position in the unit 1. Each of faces 4 is composed by a panel 6.

Figure 2:
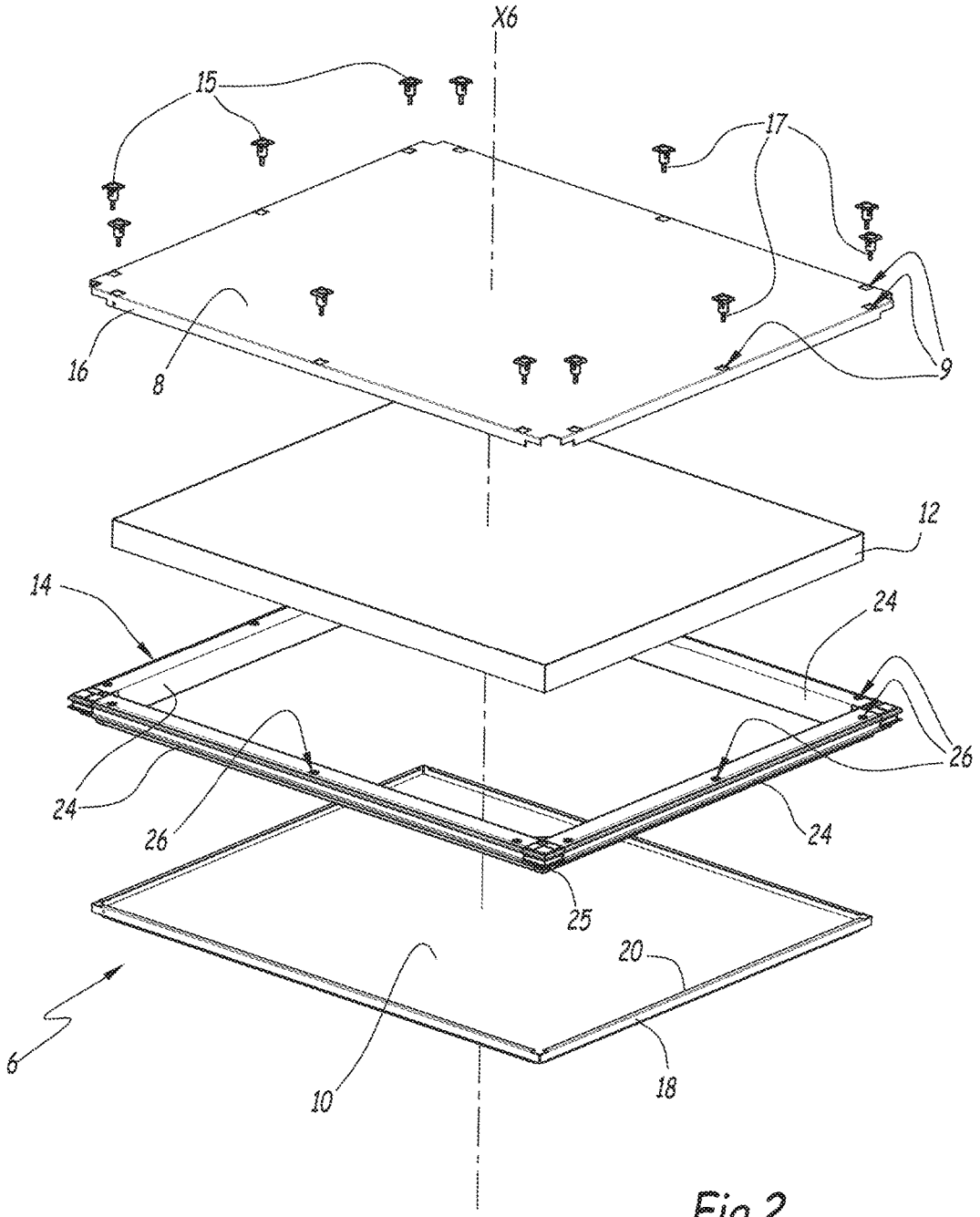
FIG. 2 is a perspective exploded view of the air handling unit in FIG. 1.

As FIG. 2 shows, each panel 6 defines a main axis X6 perpendicular to its surface. Furthermore, each panel 6 comprises a first plate 8, a second plate 10, a layer 12 of insulating material, a joining element 14, a plurality of screwing barrels 15 and of screws 17.

The plate 8 is also called an outside plate because it is positioned outside of the air handling unit 1. The plate 10 is also called an inside plate because it is positioned inside the air handling unit 1.

The outside plate 8 is provided with four folded-down edges 16. In particular, the folded-down edges 16 of the plate 8 are oriented parallel to the main axis X6 of the panel 6 and toward the inner plate 10. Furthermore, the outer plate 8 comprises a plurality of bores 9 arranged along its contour, more precisely, three bores 9 on each side. The bores 9 are configured to receive the assembly barrels 15 during the assembly of the panel 6.

The inside plate 10 is provided with four folded-down edges 18. The folded-down edges 18 are oriented parallel to the main axis X6 of the panel 6 and toward the inner plate 8. Furthermore, the folded-down edges 18 each comprise a folded-down end part 20 which is oriented perpendicularly to the main axis X6 of the panel 6 and toward the center of the inner plate 10.

In a variant not shown in the figures a single plate from the outside plate 8 and the inside plate 10 is provided with folded-down edges.

The plates 8 and 10 and the layer of insulating material 12 are parallel to each other and perpendicular to the main axis X6 of the panel 6.

The outer plate 8 and the inner plate 10 are metallic. In a variant the plates 8 and 10 consist of polymeric material.

The layer of insulating material 12 is configured so as to thermally insulate the panel 6. In practice, the layer 12 is configured to reduce the passage of heat from the inside to the outside of the air handling unit 1 or from the outside to the inside. In order to do this, the layer 12 is, for example, a block of fibers, of mineral, vegetable or synthetic foam.

The layer of insulating material 12 is arranged between the outer plate 8 and the inner plate 10. The layer of insulating material 12 is integrated, for example, with the aid of a self-adhesive band to the outer plate 8 and to the inner plate 10.

The joining element 14, also called "decoupling contour" is configured so as to realize the mounting of a panel and to ensure the assembly between several panels so as to permit the construction of the modules 2 of the unit 1. The joining element 14 is also configured so as to reduce the passage of heat from the inside to the outside or from the outside to the inside of the air handling unit 1. In order to do this, the joining element 14 consists of thermally insulating material, in particular of polymeric material. Finally, the joining element 14 belongs to a structural framework of the unit 1. Such a framework is composed exclusively of the joint elements 14, which are designed to be sufficiently rigid and persistent to the loads from the unit 1.

The joining element 14 is arranged around the layer of insulating material 12 and intercalated between the outer plate 8 and the inner plate 10 along the main axis X6. As FIG. 2 shows, the joining element 14 comprises four bars 24 with an identical transversal section and with different lengths. The length of the bars 24 is a function of the panel 6 for which they are configured.

The four bars 24 are therefore arranged in a rectangle and four corners 25 are provided in order to nest the ends of the bars 24 in such a manner as to immobilize the bars 24 and to construct the joining element 14.

In this case the panel 6 are rectangular, as can be seen in FIG. 1. In practice, the panels 6 can be rectangular or square.

As can be seen in FIG. 2, each bar 24 comprises three bores 26. During the mounting of the panel 6, the bores 26 of the joining element 14 are in correspondence along the main axis X6, with the bores 9 of the outer plate 8 and therefore with the screwing barrels 15. The assembly screws 17 are provided in order to integrate the outer plate 8 with the joining element 14.

Figure 3:
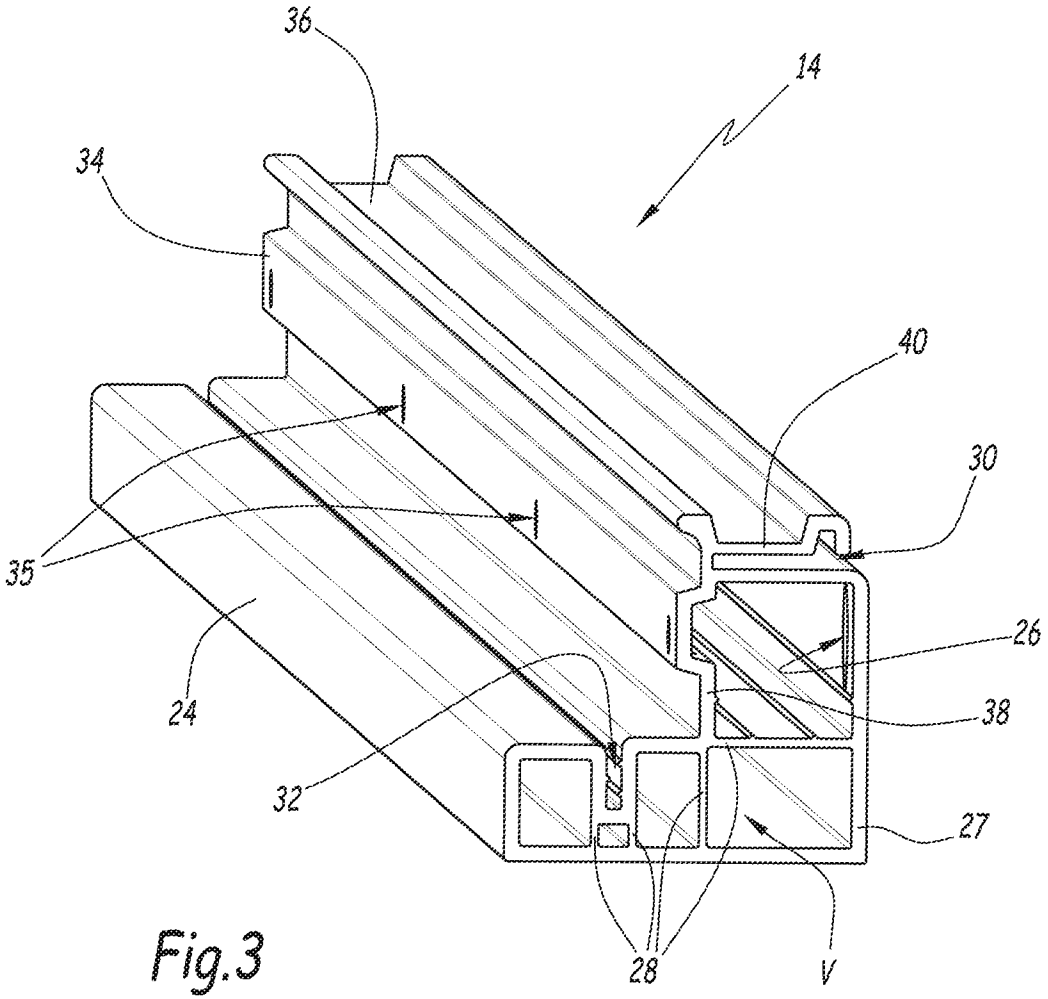
FIG. 3 is a perspective view of a joining element of the panel of FIG. 2.

Referring to the transversal section of a bar 24 shown in the FIG. 3, the joining element 14 comprises an outer contour 27 which defines a closed volume V of the joining element 14. The joining element 14 also comprises stiffening ribs 28 arranged inside the closed volume V. The contour 27 of the joining element 14 defines a first niche 30 and a second niche 32.

The first niche 30 receives the folded-down edges 16 of the outer plate 8. The second niche 32 is perpendicular to the first niche 30 and receives the folded-down edges 18 of the inner plate 10. In particular, the folded-down part 20 of each folded-down edge 18 is arranged in the second niche 32 of the joining element 14.

Furthermore, the joining element 14 comprises both a male assembly part 34 and a female assembly part 36. The male assembly part 34 is formed by a projecting rib and the female assembly part 36 formed by a hollow groove.

The projecting rib 34 is arranged on a first wall 38 of the contour 27 of the joining part 14. This wall 38 is arranged perpendicular to the main axis X6 of the panel 6 and parallel to the plates 8 and 10. Three bores 35 are arranged in a projecting rib 34 and correspond to the bores 26 of the bar 24.

The hollow groove 36 is arranged on a second wall 40 of the contour 27 of the joining element 14. This wall 40 is arranged parallel to the main axis X6 of the panel 6 and perpendicular to the wall 38. Furthermore, the first niche 30 is arranged between the closed volume V and the hollow groove 36.

Figure 4:
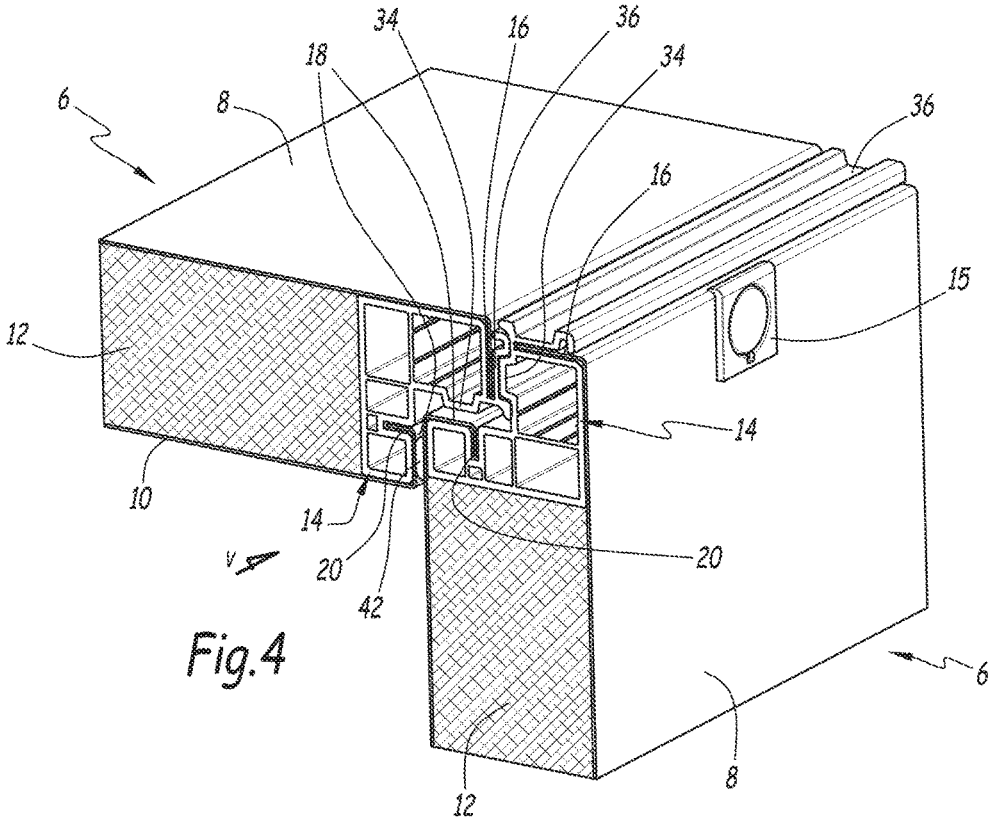
FIG. 4 is a partial perspective view of two panels of the type of the one in FIG. 2 in a configuration assembled at a right angle.

As FIG. 4 shows, the projecting rib 34 of the joining element 14 is configured to fit into the hollow groove 36 of another joining element 14 with an identical transversal section belonging to another panel 6. In particular, the hollow groove 36 of the joining element 14 of the panel 6 of a first face 4 of a module 2 receives the projecting rib 34 of the joining element 14 of the panel 6 of a second face 4 of this module 2 adjacent to the first face 4 and perpendicular to the latter.

Figure 5:
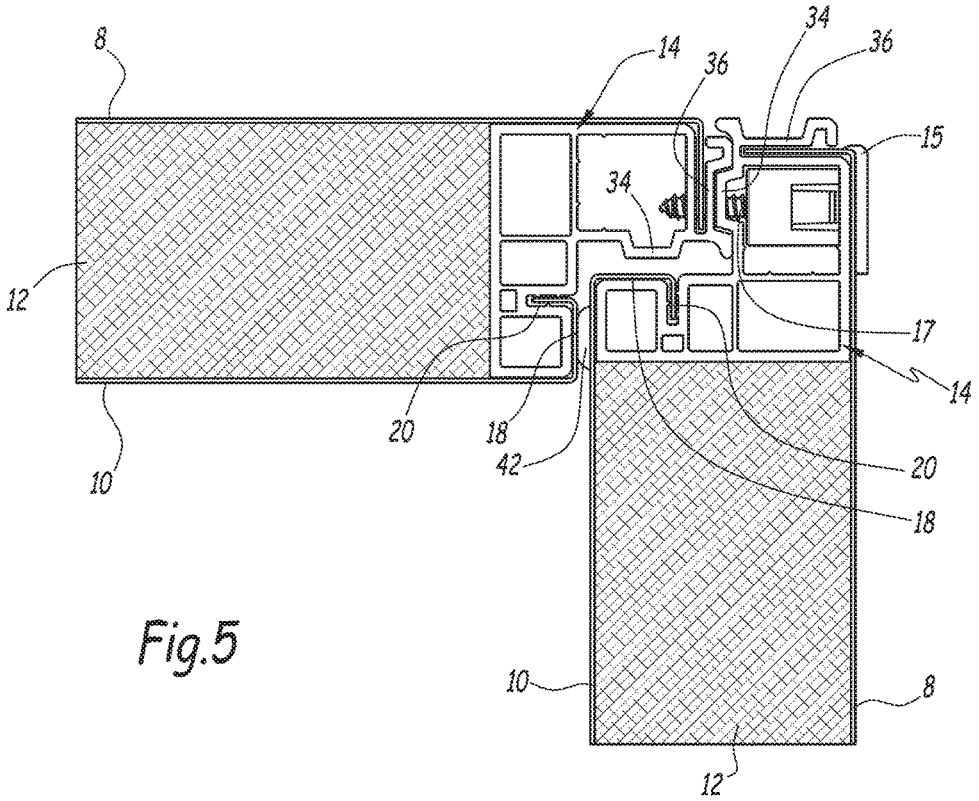
FIG. 5 is a section according to plan V in FIG. 4.

As FIG. 5 shows, during the mounting of the panel 6 the screwing barrels 15 are arranged in the bores 9 of the outer plate 8 and therefore in the bores 26 of the bars 24. The barrels 15 also correspond to the bores 35 of the projecting ribs 34. The screws 17 integrate the plate 8 to the bars 24. A joint 42 is provided during the mounting in order to ensure the tightness of the modules 2. The joint 42 is arranged between the inner plates 10 precisely between an inner plate 10 of the panel 6 and the turned-down edge 18 of another plate 10 of an adjacent panel 6.

Figure 6:
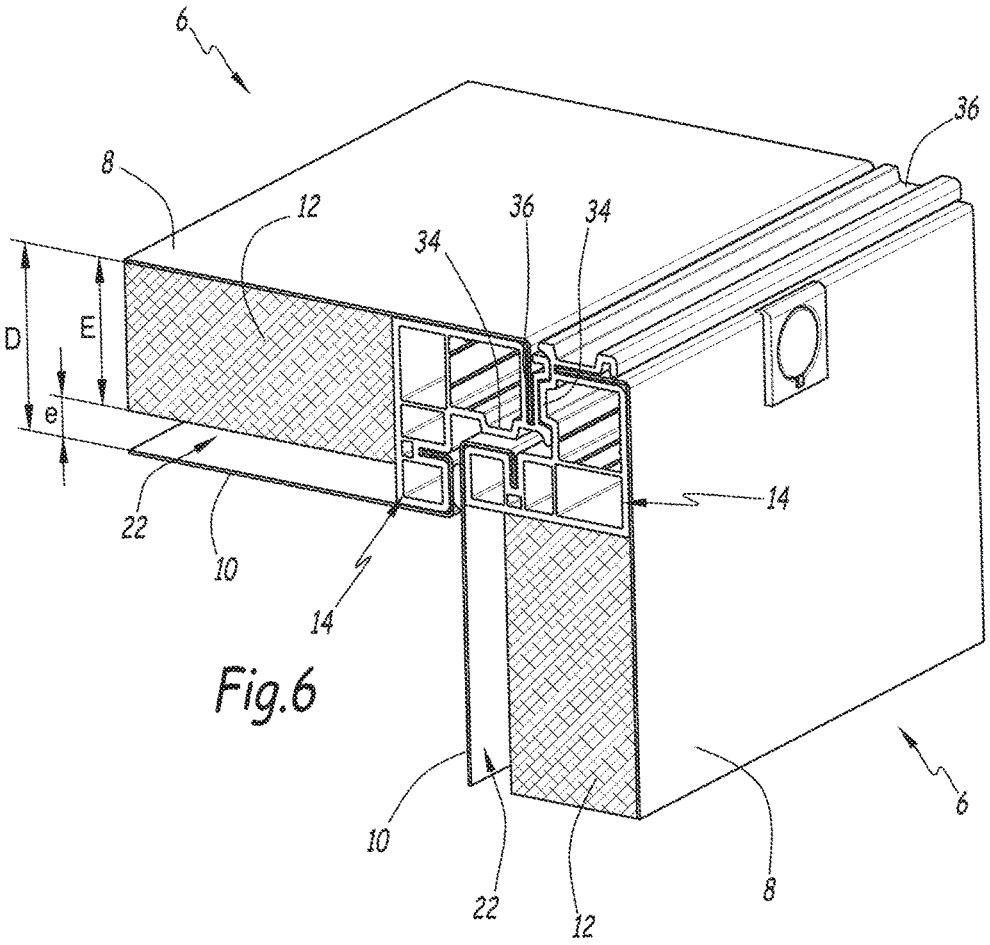
FIG. 6 is a view analogous to FIG. 4 for two panels of a second embodiment of the invention.

According to the second embodiment of the invention shown in FIG. 6 an interval 22 with a thickness e parallel to the main axis X6 of the panel 6 is defined between the layer of insulating material 12 and the inner plate 10. Note the inner distance D between the plates 8 and 10 measured parallel to the main axis X6. The distance D is comprised between 25 and 85 mm, preferably equal to 50 mm. Note also the thickness E of the layer of insulating material 12 measured parallel to the main axis X6 of the panel 6. The thickness E is lower than the distance D and preferably equal to 40 mm. The thickness e of the interval 22 is measured parallel to the axis X6 and is greater than or equal to 10 mm. The distance D is equal to the sum of the thickness E and the thickness e.

In a variant not shown in the figures the layer of insulating material 12 is integrated, for example, with the aid of a self-adhesive band with the inner plate 10. The interval 22 with a thickness parallel to the main axis X6 of the panel 6 is therefore defined between the layer of insulating material 12 and the outer plate 8.

In another variant the layer of insulating material 12 is integrated with the aid of feet with the outer plate 8 and with the inner plate 10. In other words, a first interval with a thickness parallel to the main axis X6 of the panel 6 is defined between the layer 12 and the plate 8 and a second interval with a thickness parallel to the axis X6 is defined between the layer 12 and the plate 10.

According to another variant that is not shown, the layer of insulating material 12 is not integrated with the plates 8 and 10 but is only wedged between the plates 8 and 10.

According to another variant an interval with a thickness perpendicular to the main axis X6 is also defined on both sides of the layer of insulating material 12 precisely between the layer 12 and the joining element 14.

The embodiment and the variants envisaged above can be combined in order to generate new embodiments.

The invention claimed is:

1. A panel for a module of an air handling unit, which panel defines a main axis (X6) perpendicular to its surface and comprising:

an outer plate, an inner plate, a layer of insulating material arranged between the outer plate and the inner plate, and a joining element arranged around the layer of insulating material and intercalated between the outer plate and the inner plate along the main axis, wherein the plates and the layer of insulating material are parallel to each other and perpendicular to the main axis of the panel, wherein the joining element comprises both a male assembly part formed by a projecting rib and a female assembly part formed by a hollow groove and that the projecting rib of the joining element is configured to nest into a hollow groove of another joining element with an identical transversal section belonging to another panel;

wherein at least one plate among the outer plate and the inner plate is provided with a turned-down edge and that the turned-down edge is arranged in a niche of the joining element.

2. The panel according to claim 1, wherein the projecting rib and the hollow groove of the joining element are arranged on faces of the joining element which are perpendicular among themselves.

3. The panel according to claim 1, wherein the joining element comprises of thermally insulating material.

4. The panel according to claim 3 wherein the thermally insulating material comprises a polymeric material.

5. The panel according to claim 1, wherein the joining element comprises stiffening ribs arranged inside a closed volume (V) defined by a contour of the joining element.

6. The panel according to claim 1, wherein an interval with a thickness (e) parallel to the main axis (X6) of the panel is defined between the layer of insulating material and a plate from the outer plate and the inner plate.

7. A module for an air handling unit, which module comprises several faces, at least one face of which is composed by the panel according to claim 1.

8. The module according to claim 7, wherein the hollow groove of the joining element of the panel of a first face receives the projecting rib of the joining element of the panel of a second face adjacent to the first face and perpendicular to the latter.

9. An air handling unit comprising a plurality of modules, wherein at least one module of the plurality of modules is in accordance with claim 8, and the joining element belongs to a structural framework for the unit.

10. A panel for a module of an air handling unit, which panel defines a main axis (X6) perpendicular to its surface and comprising:

an outer plate, an inner plate, a layer of insulating material arranged between the outer plate and the inner plate, and a joining element arranged around the layer of insulating material and intercalated between the outer plate and the inner plate along the main axis, wherein the plates and the layer of insulating material are parallel to each other and perpendicular to the main axis of the panel, wherein the joining element comprises both a male assembly part formed by a projecting rib and a female assembly part formed by a hollow groove and that the projecting rib of the joining element is configured to nest into a hollow groove of another joining element with an identical transversal section belonging to another panel;

wherein:

the joining element comprises two niches, which respectively receive a turned-down edge of the outer plate and a turned-down edge of the inner plate, the joining element defines a closed volume (V), the projecting rib is arranged on a wall of the closed volume, a first niche is defined between the closed volume and the hollow groove, and the second niche is perpendicular to the first niche.

* * * * *